US006484646B1

(12) United States Patent
Salonen et al.

(10) Patent No.: US 6,484,646 B1
(45) Date of Patent: Nov. 26, 2002

(54) WORK SURFACE PARTICULARLY DESIGNED FOR COMPUTERS OR COMPUTER TERMINALS

(75) Inventors: Ari Salonen, Turku (FI); Jari Pihlajamäki, Seinäjoki (FI)

(73) Assignee: Wallfund Oy, Seinajoki (FI)

( * ) Notice: Subject to any disclaimer, the term of this patent is extended or adjusted under 35 U.S.C. 154(b) by 0 days.

(21) Appl. No.: 09/600,248

(22) PCT Filed: Jan. 12, 1999

(86) PCT No.: PCT/FI99/00016

§ 371 (c)(1),
(2), (4) Date: Jul. 13, 2000

(87) PCT Pub. No.: WO99/35937

PCT Pub. Date: Jul. 22, 1999

(30) Foreign Application Priority Data

Jan. 13, 1998 (FI) ..... 980050

(51) Int. Cl.[7] ..... A47B 37/00
(52) U.S. Cl. ..... 108/50.01; 248/918
(58) Field of Search ..... 108/50.02, 50.01, 108/43; 248/917, 918

(56) References Cited

U.S. PATENT DOCUMENTS

| | | | | | |
|---|---|---|---|---|---|
| 4,932,332 | A | * | 6/1990 | Noda | 108/50.02 |
| 5,174,223 | A | * | 12/1992 | Nagy et al. | 108/50.01 |
| 5,490,466 | A | * | 2/1996 | Diffrient | 108/50.01 X |
| 5,509,628 | A | * | 4/1996 | Noble | 248/918 X |
| 5,522,323 | A | * | 6/1996 | Richard | 108/50.01 |
| 5,568,773 | A | * | 10/1996 | Hung | 108/50.01 X |
| 5,605,311 | A | * | 2/1997 | McGrath et al. | 248/918 X |
| 5,704,298 | A | * | 1/1998 | Corpuz, Jr. et al. | 108/50.01 |
| 5,704,299 | A | | 1/1998 | Corpuz, Jr. et al. | |
| 5,845,586 | A | * | 12/1998 | Moore | 108/50.01 |
| 6,045,098 | A | * | 4/2000 | Timm | 248/918 X |
| 6,244,547 | B1 | * | 6/2001 | Tonizzo et al. | 248/918 X |
| 6,247,672 | B1 | * | 6/2001 | Bello | 248/918 X |

FOREIGN PATENT DOCUMENTS

| | | |
|---|---|---|
| DE | 4009536 A1 | 9/1991 |
| EP | 0506268 A1 | 9/1992 |
| EP | 0876780 A2 | 11/1998 |
| FR | 1383122 | 11/1994 |
| SE | 2901 | 5/1890 |
| SE | 454401 | 5/1988 |
| WO | WO 9600022 | 4/1996 |

* cited by examiner

*Primary Examiner*—Jose V. Chen
(74) *Attorney, Agent, or Firm*—Young & Thompson

(57) ABSTRACT

Work surface particularly designed for computer work or terminal operations is designed to prevent injuries of the neck, wrist and arms and excessive visual strain that commonly occur in computer and other terminal work by supporting the forearms of a person working at the computer or terminal at their entire length between the elbow and the wrist. The support to the forearms at their entire length is provided by a portion of the work surface being arranged to curve downwardly in such a way that the lowest point of the top surface of the work surface is close to the user and the highest to the keyboard and the mouse surface so that the user rests his/her arms on the work surface during work.

3 Claims, 3 Drawing Sheets

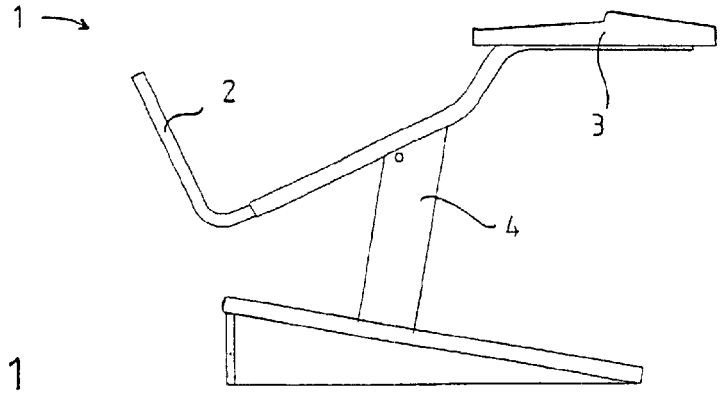
FIG. 1
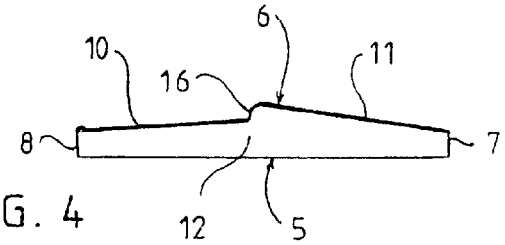
FIG. 4
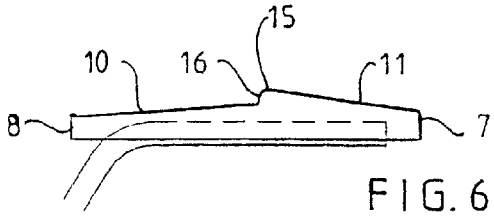
FIG. 6
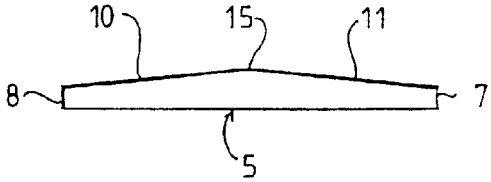
FIG. 5
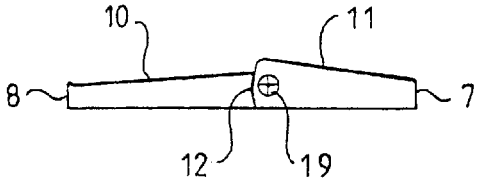
FIG. 7
FIG. 8
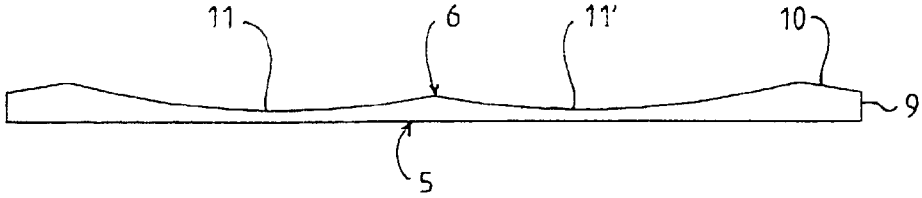
FIG. 9
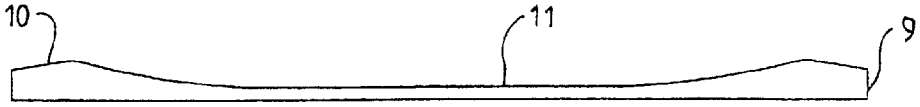
FIG. 10
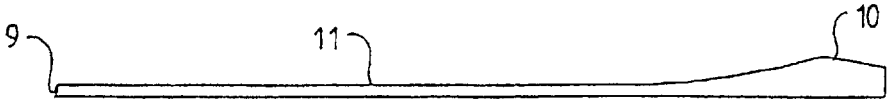

WORK SURFACE PARTICULARLY DESIGNED FOR COMPUTERS OR COMPUTER TERMINALS

BACKGROUND OF THE INVENTION

The invention relates to a work surface particularly designed for computers and computer terminals, comprising at least one tabletop and a base supporting the tabletop, the tabletop or portions of the tabletop that are closest to a person working at the work surface thus providing a keyboard platform which is arranged to at least partially surround the user, the front edge of the tabletop forming a user space with a curvilinear or fractional edge line, the keyboard platform comprising a support surface receiving the user's arms, and a keyboard surface receiving the keyboard and a mouse.

DESCRIPTION OF RELATED ART

Computer work and other similar terminal operations commonly cause various problems related to injuries in the neck, wrists and arms, and excessive visual strain. Such problems are mainly due to ergonomically poor working conditions, i.e. the workplace is unsuitable for the user. This may be because of an unsuccessful choice of chair or incorrectly positioned equipment. The most usual reason, however, is a combination of these two main reasons.

Usually it turns out that the display terminal is placed too high up at the workplace, or that the display terminal and the keyboard are incorrectly located in relation to each other. A display terminal placed too high up causes extra movement of the head, which leads to tension in the neck, thereby inflicting pain. An inappropriate location of the display terminal and the keyboard in relation to each other cause increased visual strain because the eyes are constantly focused alternately on the display terminal and the keyboard.

It is also common that the keyboard is unsatisfactorily positioned for the user, thus causing tension and pain in the shoulders, forearms and wrists.

Up to the present, attempts have been made to solve the above ergonomic problems by means of various kinds of auxiliary devices fastened to the workplace. It is therefore known to provide the keyboard with wrist supports having an articulated arm supporting the user's wrists when his/her hands operate the keyboard. In addition, it is known to use different kinds of fixed wrist supports arranged in front of the keyboard. Such fixed wrist supports have also been arranged for operating a mouse on a mouse surface. Other arrangements for operating the mouse include different articulated arm plates on which the user rests his/her forearm when moving the mouse.

In the latest solutions the workplace is provided with a space receiving the user. In a desk provided with such a space, the tabletop extends on both sides of the user sitting at the desk, thereby partially surrounding him/her and, at the same time, providing better support for the user's arms.

A problem with the known solutions is, however, that separate wrist supports are not only expensive but also inconvenient to use, because such wrist supports hamper other operations. Fixed wrist supports arranged in conjunction with the keyboard or, the mouse, and the new work surface provided with a space for the user do support the wrist and the forearm, but not sufficiently. The support such solutions provide to the wrist or the forearm is extremely local, therefore they fail to remove tension in the user's arms, shoulders and in the neck area.

SUMMARY OF THE INVENTION

The solution of the invention succeeds in providing a fully novel work surface an object of which is to prevent, as effectively as possible, stress injuries from occurring. The work surface of the invention offers maximum support to the wrists and arms of a person working at the equipment, ensuring, however, at the same time a pleasant and natural working position.

This object is achieved with a work surface having the characteristics of the present invention as disclosed in the claims. More specifically, a device of the invention is principally characterized in that, in its working position, the support surface curves substantially downwardly in such a way that at least its top surface is arranged to be lower down substantially at every point of the curvilinear or fractional edge line of the front edge of the user space than at a connect surface forming between the support surface and the keyboard surface.

In other words, the idea of the invention is to fully support the forearm between the elbow and the wrist so that, when a person places him/herself in front of the work surface, the height of the work surface can be adjusted in such a way that the person can rest his/her forearms on the work surface. A portion of the top surface of the work surface being arranged to curve downwardly so that the lowest point of the top surface of the work surface is close to the user and the highest point is close to the keyboard and the mouse surface, allows the work surface to support the forearm at its entire length. When a person is working at this kind of a work surface, all the motions of his/her forearm follow the work surface in a natural manner. To support all arm motions, the work surface can be formed into a conical or double-conical form. The keyboard portion of the work surface being arranged to curve downwardly allows a natural position to be obtained for the hands, too, thereby avoiding any extra tension to the arms and wrists during keyboard operations.

By providing at least a partially stepped separation of the keyboard surface from the support surface also allows an ergonomically advantageous working position to be obtained. Another way to lower the keyboard in relation to the support surface is to provide the keyboard surface with a separate recess or depression that receives the keyboard. In this case, the mouse surfaces at the sides of the keyboard are, however, advantageously arranged to continue from the support surface following a continuous fractional or curved line, without any vertical discontinuity.

By arranging the support surface to be fully or partly resilient or bending at the user's side it is possible to provide an arm support which is always correctly focused.

By arranging the top surface of the keyboard platform, in turn, to approach substantially horizontal at the edge zones allows excellent conditions to be obtained for mouse operations. A keyboard platform designed in this way allows mice of different sizes to be used, the platform still always providing sufficient support for the user's wrist.

BRIEF DESCRIPTION OF THE DRAWINGS

The invention will be now described in greater detail with reference to the accompanying drawings, in which FIG. 1 is a side view of a work surface;

FIG. 4 is a cross-sectional view at points A—A of the keyboard platform shown in FIG. 2;

FIG. 5 is an alternative cross-sectional view at the points A—A of the keyboard platform shown in FIG. 2;

FIG. 6 is a cross-sectional view at points B—B of the keyboard platform shown in FIG. 2;

FIG. 7 is an alternative cross-sectional view at the points B—B of the keyboard platform shown in FIG. 2, the platform comprising a longitudinal joint;

FIG. 8 is a longitudinal section at points C—C of the keyboard platform shown in FIG. 2;

FIG. 9 is an alternative longitudinal section at the points C—C of the keyboard platform shown in FIG. 2;

FIG. 10 is an alternative longitudinal section at the points C—C of the keyboard platform shown in FIG. 3;

DESCRIPTION OF THE PREFERRED EMBODIMENT

Figure 2:
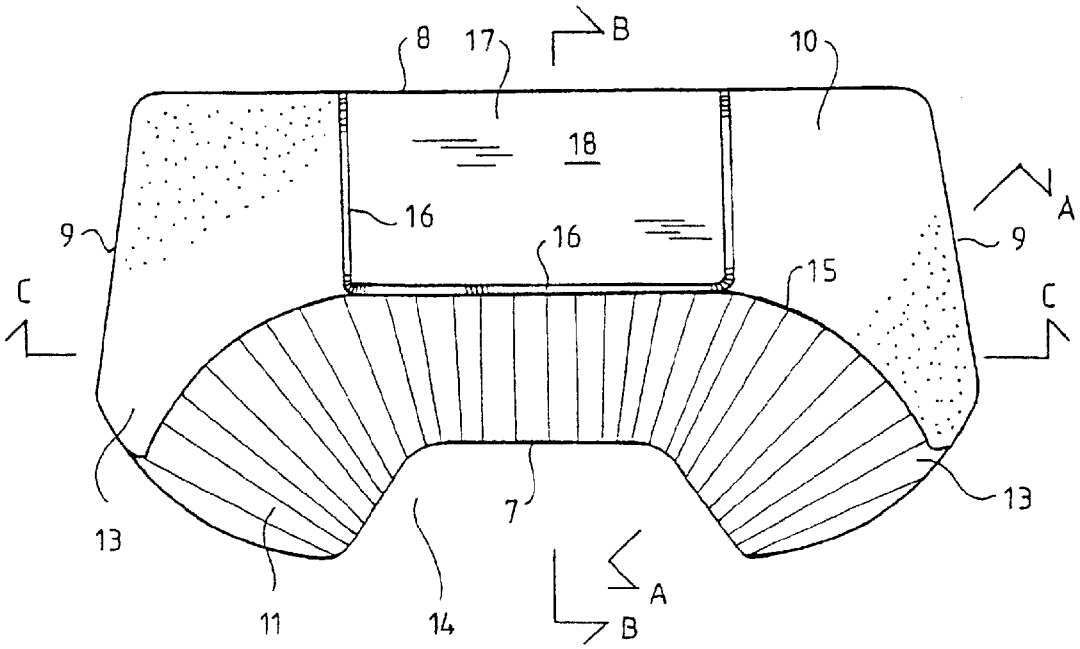
FIG. 2 shows a preferred embodiment of a keyboard platform of the work surface.

FIGS. 1 and 2 show a preferred embodiment of a work surface 1. The embodiment shown in the FIG. 1 does not specifically indicate how the display terminal is fastened. The display terminal can therefore be arranged to the work surface, for example, by means of a separate fastening arrangement 2 such as the one shown in the Figure, or it can be detached from the surface.

The work surface I of the invention thus comprises a fastening arrangement for the display terminal 2, and a keyboard platform 3 comprising at least one tabletop. The design also comprises a base 4 which is articulated in a manner known per se, thereby allowing the height of the display terminal and the keyboard platform to be adjusted.

The keyboard platform preferably comprises one plane-like piece, as shown in FIG. 2, but it can equally well be manufactured of a plural number of pieces.

The described keyboard platform 3 comprises a bottom surface 5 and a top surface 6. The keyboard platform further includes a front edge 7 facing the user, a rear edge 8 opposite to the front edge, and side edges 9 joining the two together. The top surface is divided into a keyboard surface 10 provided for the keyboard and the mouse, and a support surface 11 located between the keyboard surface and the user. The support surface and the keyboard surface are separated by what is known as a connect surface 12. The support surface is further arranged to partially surround the user, at least at his/her one side, by means of wing-like portions 13. Consequently, at the keyboard platform edge facing the user, i.e. at the keyboard platform front edge 7, the described support surface is provided with a user space 14.

The support surface 11 with its wing-like portions 13 is arranged to receive the user's forearms, the support surface thus supporting the forearm at its entire length between the elbow and the wrist. To provide this, the support surface is arranged, unlike a conventional support surface, to curve downwardly when in working position. In working position, the top surface of the support surface is therefore lower down at the front edge 7, at its entire or substantial width, than at the joint between the keyboard surface 10 and the support surface 11, i.e. the connect surface 12. The support surface is thus designed to receive the user's forearm at its entire length, no matter where on the support surface he/she places his/her arm. On the keyboard platform is thereby formed a fold, or ridge 15, at the user's wrist, the distance of the ridge from the user being arranged to correspond to a natural motion of the wrist of the person using the work surface 1.

An example of a support surface 11 design of the invention is shown in FIG. 8 where the support surface is provided with two conical concave portions. A work surface curved in this way provides both arms with a separate conical surface 11, 11' to support the motion of the arms on the support surface. Such a surface can be thought to be in the form a cone, its point setting substantially at the user's elbow.

The support surface 11 can, however, be shaped in various ways; another advantageous design is provided by a flat portion arranged in the mid-area of the support surface, as shown in FIG. 9, the portion raising substantially conically towards the opposite side edges 9 of the keyboard platform 3.

The support surface 11 of the FIGS. 2, 8 and 9 is advantageously arranged symmetrically in relation to the central axis of the space 14 on the support surface, the surface of the keyboard platform 3 being manufactured of a resilient, plastic-coated material, for example, which is easy to clean and to shape.

Figure 3:
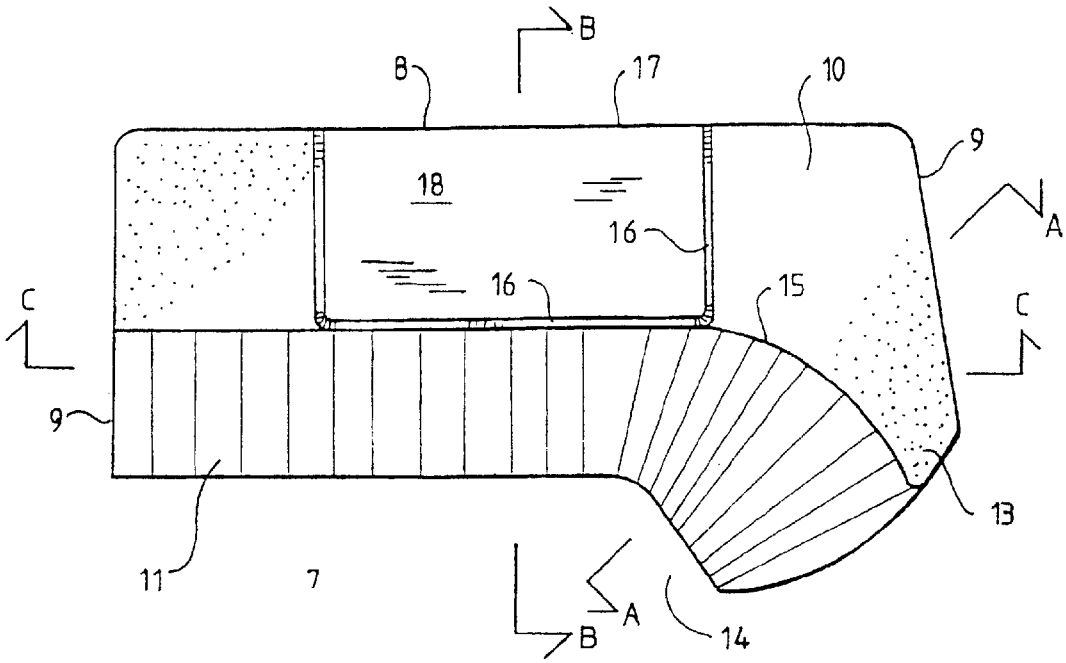
FIG. 3 shows another embodiment of the keyboard platform of the work surface of the invention, the platform having an asymmetric space for the user.
Figure 11:
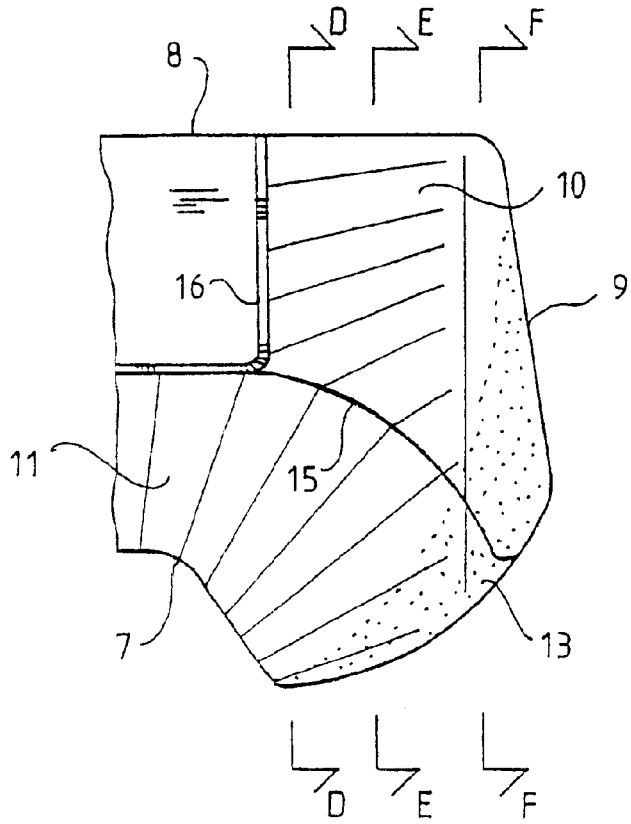
FIG. 11 is an alternative design of a keyboard surface end.

A further preferred embodiment of the keyboard platform 3 comprises a platform, as shown in FIG. 3, in which the support surface 11 is arranged to surround the user, by means of a wing-like portion 13 of the keyboard platform, only at his/her one side. Similarly as in a keyboard platform shown in FIG. 2, also this support surface may be considered to comprise a user space 14 at the front edge 7. This kind of a work surface is particularly suitable for work involving intensive use of the mouse.

The top surface of the support surface 11 of the keyboard platform 3 shown in FIG. 3 is not a conventional platform surface either. It is also arranged to curve downwardly, the front edge 7 of the platform thus being lower down, in its working position, than the connect surfaces 12 forming between the keyboard surface 10 and the support surface 11. As shown in FIG. 10, the support surface thereby formed is flat from the mid-area of the support surface all the way to one of the side edges 9, raising substantially conically towards the opposite side edge 9 of the keyboard platform.

A preferred embodiment of the keyboard platform 3 of the work surface 1 is advantageously manufactured as a single piece, the platform thus comprising a urethane foam core in a coating made of a material impervious to soil. The platform is advantageously stiffened by using stiffening elements arranged to the platform, such as steel tube, carbon fibre rods or other rod-like or net-like members suitable for the purpose.

The keyboard surface 10 and the support surface 11 forming the top surface of the keyboard platform 3 are preferably arranged at an angle relative to each other, as shown in FIGS. 4, 5 and 6, the angle between the keyboard surface and the support surface, as seen from the bottom surface 5, being 160° to 180°. In addition, the connect surface 12 forming between the keyboard surface and the support surface is advantageously provided, at least in the area receiving the keyboard, with a step 16 as shown in FIGS. 4 and 6, the step forming a vertical displacement of the keyboard surface, the displacement being 15 to 40 mm. A keyboard placed on the keyboard surface can thus be better focused at a natural height for user's finger tips, the user's arms resting at the same time relaxed on the curved support surface 11 of the invention. In a preferred embodiment of the invention, the keyboard surface is provided with a recess, or depression 17, shown in FIGS. 2 and 3, the keyboard placed in the recess being at a lower level than the keyboard surface surrounding it. A bottom surface 18 of such a recess is surrounded, preferably at least at three adjacent sides of the recess, by the above-mentioned step 16.

On the other hand, when the work involves mouse operations, the step 16 between the keyboard surface 10 and the support surface 11 is not always desirable. In such case, the connect surface 12 forming between the keyboard surface and the support surface can either be furnished with the step 16, as shown in FIG. 4, or the keyboard surface can be joined directly, at the same level, to the support surface, as shown in FIG. 5.

The support provided to the arms by the support surface 11 can be further improved by arranging the keyboard surface 3 to turn about its longitudinal axis. This allows the support surface to be always focused in such a way that the forearm rests at its entire length on the support surface. Alternatively, the support surface can be made resilient so that, when the user places his/her arms on the support surface, it yields downward and sets at an angle exactly suitable for the user. In addition, to the keyboard platform can be arranged at least one joint 19 parallel to its longitudinal axis, as shown in FIG. 7, one or more portions of the support surface being arranged to turn about the joint.

Since various different types of mice are used today, it is important that they all could be used as well as possible on the work surface 3. To this effect, the angle of a portion of the work surface area can be arranged to change, thus providing a surface which gradually becomes substantially horizontal towards the side edge. A work surface such as this is shown in FIGS. 11 to 14.

Figure 12:
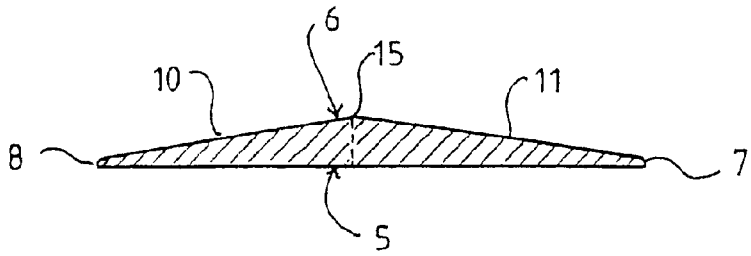
FIG. 12 is a cross-sectional view at points D—D of the keyboard platform shown in FIG. 11.
Figure 13:
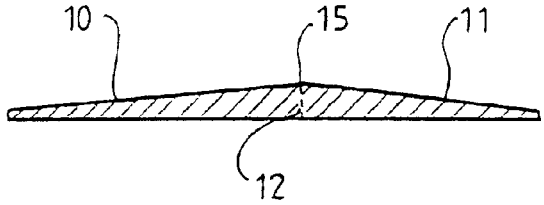
FIG. 13 is a cross-sectional view at points E—E of the keyboard platform shown in FIG. 11.
Figure 14:
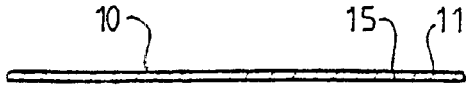
FIG. 14 is a cross-sectional view at points F—F of the keyboard platform shown in FIG. 11.

The ridge 15 on the top surface 6 is then arranged to approach to the bottom surface 5 of the work surface, the angle between the support surface 11 and the keyboard surface, also known as a ridge angle, thereby increasing, as shown in FIGS. 12, 13 and 14, so that the angle finally is substantially 180°. A top surface design such as this provides a keyboard surface in which a smaller ridge angle close to the keyboard provides a higher support point for the user's wrist, thereby extending the distance between the hand and the keyboard surface. Consequently, the distance between the hand and the keyboard surface becomes shorter towards the side edge 9 of the work surface, so smaller mice can be used, without causing flexion in the wrist, when the hand kept at the far side of the surface.

It is to be understood that the above description and the related Figures are only intended to illustrate the present invention. The invention is therefore not restricted only to the above description or the embodiment disclosed in the claims, but it will be apparent to those skilled in the art that many variations and modifications may be made to the present invention without departing from the inventive idea defined in the attached claims.

What is claimed is:

1. A work surface for computer and computer terminal users, comprising:

at least one tabletop;

a base (4) supporting said tabletop, the tabletop or portions of the tabletop that are designed to be closest to a person working at the work surface providing a keyboard platform (3), the keyboard platform being arranged to at least partially surround the user;

a user space (14) formed by a front edge (7) of the tabletop, the keyboard platform having a support surface (11) with a top surface (6) adapted for receiving the user's complete forearm from the user's wrist to the user's elbow during all time of use of the work surface, a keyboard surface (10) for receiving a keyboard and a mouse, and a connect surface (12) formed between the support surface and the keyboard surface, wherein in a working position the support surface curves downwardly so that at least the top surface of the support surface is lower, at substantially every point of a curvilinear or a fractional edge line of a front edge of the user space, than at the connect surface, wherein at least at a location for the keyboard on the keyboard surface, the connect surface (12) is provided with a step (16).

2. A work surface (1) according to claim 1, wherein the step (16) is provided at the keyboard location on the keyboard surface (10) with a recess (17) for receiving the keyboard formed in the keyboard surface by the step, the recess having a bottom surface (18) which is at a lower level than the top surface of a surrounding keyboard surface.

3. A work surface for computer and computer terminal users, comprising:

at least one tabletop;

a base (4) supporting said tabletop, the tabletop or portions of the tabletop that are designed to be closest to a person working at the work surface providing a keyboard platform (3), the keyboard platform being arranged to at least partially surround the user;

a user space (14) formed by a front edge (7) of the tabletop, the keyboard platform having a support surface (11) with a top surface (6) adapted for receiving the user's complete forearm from the user's wrist to the user's elbow during all time of use of the work surface, a keyboard surface (10) for receiving a keyboard and a mouse, and a connect surface (12) formed between the support surface and the keyboard surface, wherein in a working position the support surface curves downwardly so that at least the top surface of the support surface is lower, at substantially every point of a curvilinear or a fractional edge line of a front edge of the user space, than at the connect surface, wherein to allow the support surface (11) to be vertically bent, the support surface is provided at least with one longitudinal joint member (19).

* * * * *